US006915642B2

(12) United States Patent
Ravex

(10) Patent No.: US 6,915,642 B2
(45) Date of Patent: Jul. 12, 2005

(54) APPARATUS AND METHOD FOR EXTRACTING COOLING POWER FROM HELIUM IN A COOLING SYSTEM REGENERATOR

(75) Inventor: Alain Ravex, Sassenage (FR)

(73) Assignee: L'Air Liquide-Societe Anonyme à Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 10/347,965

(22) Filed: Jan. 21, 2003

(65) Prior Publication Data

US 2003/0163996 A1 Sep. 4, 2003

Related U.S. Application Data

(60) Provisional application No. 60/350,672, filed on Jan. 22, 2002.

(51) Int. Cl.[7] ..... F25B 9/00
(52) U.S. Cl. ..... 62/6
(58) Field of Search ..... 62/6, 259.2; 165/9.1, 165/9.2, 9.3, 9.4, 10

(56) References Cited

U.S. PATENT DOCUMENTS 3,825,063 A * 7/1974 Cowans ..... 165/146
4,491,171 A * 1/1985 Zenkner ..... 165/7
5,101,894 A * 4/1992 Hendricks ..... 165/164
5,412,952 A * 5/1995 Ohtani et al. ..... 62/6
6,164,077 A * 12/2000 Feger ..... 62/6
6,263,677 B1 * 7/2001 Hafner et al. ..... 62/6
6,286,318 B1 * 9/2001 Maguire et al. ..... 62/6

* cited by examiner

*Primary Examiner*—Denise L. Esquivel

*Assistant Examiner*—Richard L. Leung

(74) *Attorney, Agent, or Firm*—Elwood L. Haynes

(57) ABSTRACT

An apparatus for extracting cooling power from helium flowing through a cooling system regenerator includes a heat exchanger disposed within the regenerator capable of extracting cooling power from the helium and a thermal link coupled to the heat exchanger for thermally coupling the heat exchanger with a component. A method of extracting cooling power from helium in a regenerator includes flowing the helium through a first portion of the regenerator, flowing the helium through a heat exchanger disposed between the first portion and a second portion of the regenerator to transfer heat from the heat exchanger to the helium, and transferring heat from a component via a thermal link to the heat exchanger.

33 Claims, 4 Drawing Sheets

APPARATUS AND METHOD FOR EXTRACTING COOLING POWER FROM HELIUM IN A COOLING SYSTEM REGENERATOR

CROSS REFERENCE TO RELATED APPLICATIONS

This application claims the benefit of U.S. Provisional Application No. 60/350,672, filed Jan. 22, 2002, the entire contents of which are incorporated herein by reference.

BACKGROUND OF THE INVENTION

1. Field of the Invention

This invention relates to cryogenic cooling systems and, in particular, to an apparatus and a method for extracting cooling power from a cooling system regenerator.

2. Description of the Related Art

It is often desirable to cool devices, e.g., semiconductor electronics, superconducting electronics, superconducting magnets, sub-Kelvin cooling stages, and the like, to low temperatures, such as temperatures near absolute zero. The cooling systems that provide cooling to such devices are inherently thermally linked to a room-temperature environment and/or intermediate temperature environments via various structures, e.g., mechanical structures, electrical cabling and leads. The cooling capacity of such systems is also impacted by thermal radiation from the environment. These extraneous thermal sources result in a parasitic thermal load on the cooling system in addition to the thermal load created by the device or devices to be cooled. Additional thermal loads can cause power loss, cooling inefficiencies, and other problems that could be detrimental to a process or manufacturing operation.

Generally, such cooling systems are generally two-stage pulse tube, Stirling, or Gifford-McMahon type cooling systems having a first stage operating within a range of about 40K to about 100K and a second stage operating in the liquid helium temperature range, i.e., about 2K to about 6K. It is generally desirable to reduce the parasitic heat load on the lowest temperature cooling stage to increase the overall efficiency of the system. Conventionally, this problem has been addressed by operating the first stage of the cooling system at the lowest achievable temperature, resulting in less heat being transferred to the second, or lower temperature, stage. Success by this method, however, is generally limited by the cooling capacity of the first, or upper temperature, stage. Furthermore, more inefficiency (e.g., power and thermal inefficiencies) may result from this approach.

The problem has also been addressed by utilizing a three-stage cooling system having a second stage operating in the range of about 10K to about 20K. Such a system, however, is more costly and complex than a two-stage cooler and may have lower reliability.

The present invention is directed to overcoming, or at least reducing, the effects of one or more of the problems set forth above.

SUMMARY OF THE INVENTION

In one aspect of the present invention, an apparatus for extracting cooling power from helium flowing through a cooling system regenerator is provided. The apparatus includes a heat exchanger disposed within the regenerator capable of extracting cooling power from the helium and a thermal link coupled to the heat exchanger for thermally coupling the heat exchanger with a component.

In another aspect of the present invention, an apparatus for extracting cooling power from helium flowing through a cooling system regenerator is provided. The apparatus includes means for transferring heat from a component to the helium flowing through the regenerator, wherein the means for transferring the heat is disposed within the regenerator.

In yet another aspect of the present invention, a cooling system is provided. The cooling system includes a regenerator capable of allowing helium to flow therethrough, a heat exchanger disposed within the regenerator and being capable of extracting cooling power from the helium, and a thermal link coupled to the heat exchanger for thermally coupling the heat exchanger with a component.

In another aspect of the present invention, a method of extracting cooling power from helium in a regenerator is provided. The method includes flowing the helium through a first portion of the regenerator, flowing the helium through a heat exchanger disposed between the first portion and a second portion of the regenerator to transfer heat from the heat exchanger to the helium, and transferring heat from a component via a thermal link to the heat exchanger.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1:
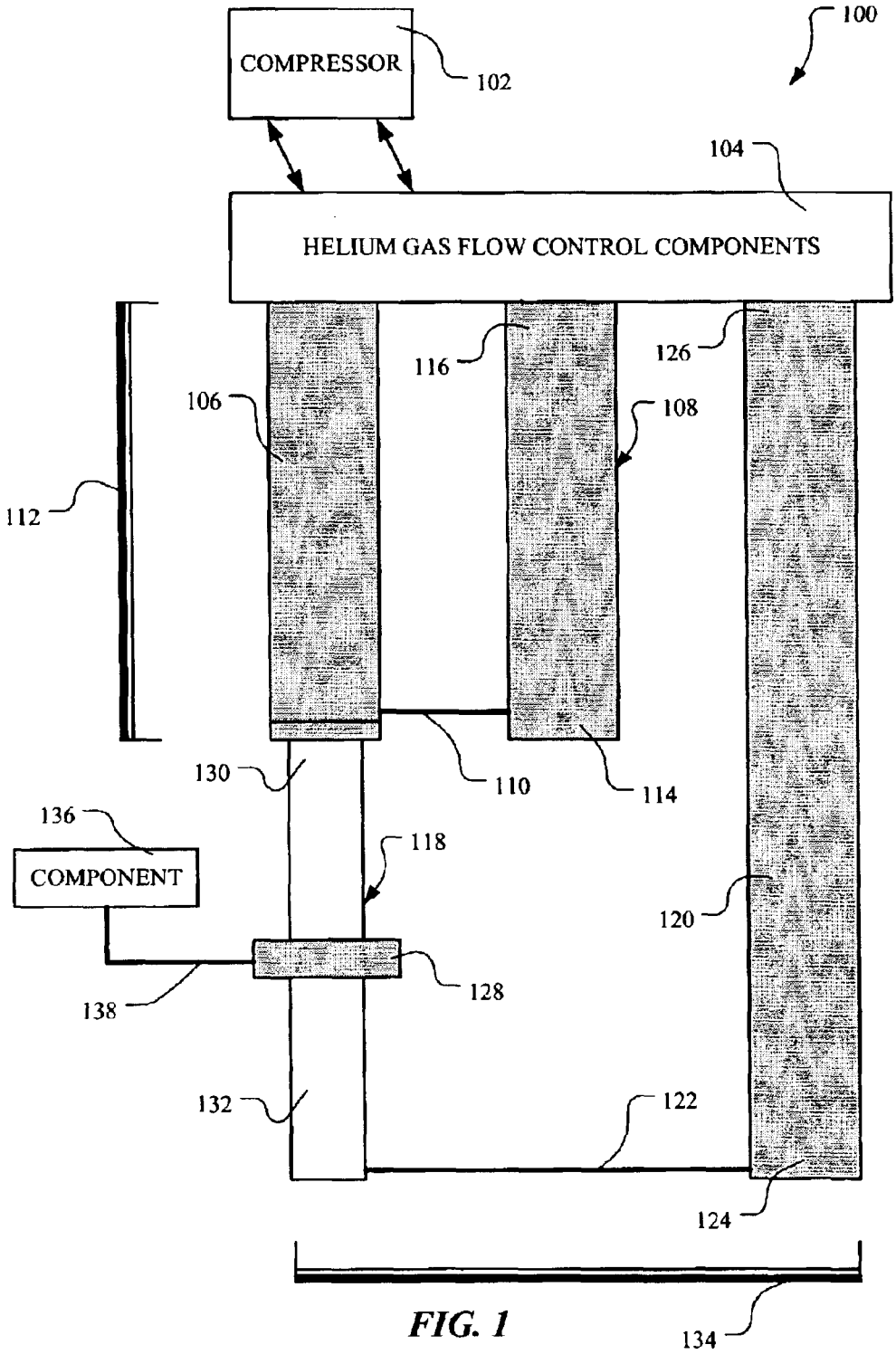
FIG. 1 is a stylized diagram of an illustrative embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

FIG. 1 depicts an illustrative embodiment of a cooling system 100 according to the present invention. The cooling system 100 includes a compressor 102 in fluid communication with various helium gas flow control components, which are indicated generally as 104 in FIG. 1. The flow control components 104 may include valves, orifices, reservoirs, and the like for controlling the flow of gaseous helium through the cooling system 100. The cooling system 100 further includes a first regenerator 106 in fluid communication with at least some of the flow control components 104 and with a first pulse tube 108 via a tube or line 110.

The first regenerator 106, and regenerators in general, is a type of heat exchanger that absorbs heat from the helium during a first part of the pressure cycle and returns heat to the helium during a second part of the pressure cycle to enhance the cooling power of the helium. The first pulse tube 106, and pulse tubes in general, function to cool the helium via changes in helium pressures therein. Generally, the first regenerator 106, the first pulse tube 108, and the line 110 comprise an upper stage 112 of the cooling system 100.

Generally, helium gas flows through the first regenerator 106, the line 110, and into the first pulse tube 108. In some embodiments, the gas may also flow through an orifice and into a reservoir, which are included in the flow control components 104. As the helium is compressed, heat in the helium gas is moved from a first end 114 of the first pulse tube 108 toward a second end 116 of the first pulse tube 108, where it is removed. Typically, temperatures proximate the first end 114 of the first pulse tube 108 may be greater than about 20K.

Still referring to FIG. 1, the cooling system 100 further includes a second regenerator 118 in fluid communication with the first stage 112 and with a second pulse tube 120 via a line 122. The first regenerator 106 and the second regenerator 118 are shown in FIG. 1 as being disposed in-line. However, those skilled in the art having benefit of the present disclosure would appreciate that the scope of the present invention is not so limited but rather may have any chosen spatial relationship between the first regenerator 106 and the second regenerator 118. In a similar fashion to that of the first stage, helium gas flows through the second regenerator 118, the line 122, and into the second pulse tube 120. In some embodiments, the gas may also flow through an orifice and into a reservoir, which are included in the flow control components 104. As the helium is compressed, heat in the helium gas is moved from a first end 124 of the second pulse tube 120 toward a second end 126 of the second pulse tube 120, where it is removed. Typically, temperatures proximate the first end 124 of the second pulse tube 120 may be within a range of about 2K to about 4K.

In the illustrated embodiment, a heat exchanger 128 is disposed between a first portion 130 and a second portion 132 of the regenerator 118. In one embodiment, the heat exchanger 128 is disposed with a physical area or zone of the regenerator 118 that operates within a temperature of about 8K to about 20K. The enthalpy difference of the helium is generally greatest within a temperature range of about 8K to about 20K. Generally, variations in the helium enthalpy may lead to thermal irreversibilities as the regenerator 118 is operated based upon temperature gradients. Thus, the regenerator 118 can become a source of cooling, via the heat exchanger 128, and the heat exchanger 128 extracts cooling power from helium flowing through the regenerator 118. In such an embodiment, the second regenerator 118, the line 122, the second pulse tube 120, and the beat exchanger 128 comprise a lower stage 134 of the cooling system 100.

Figure 2:
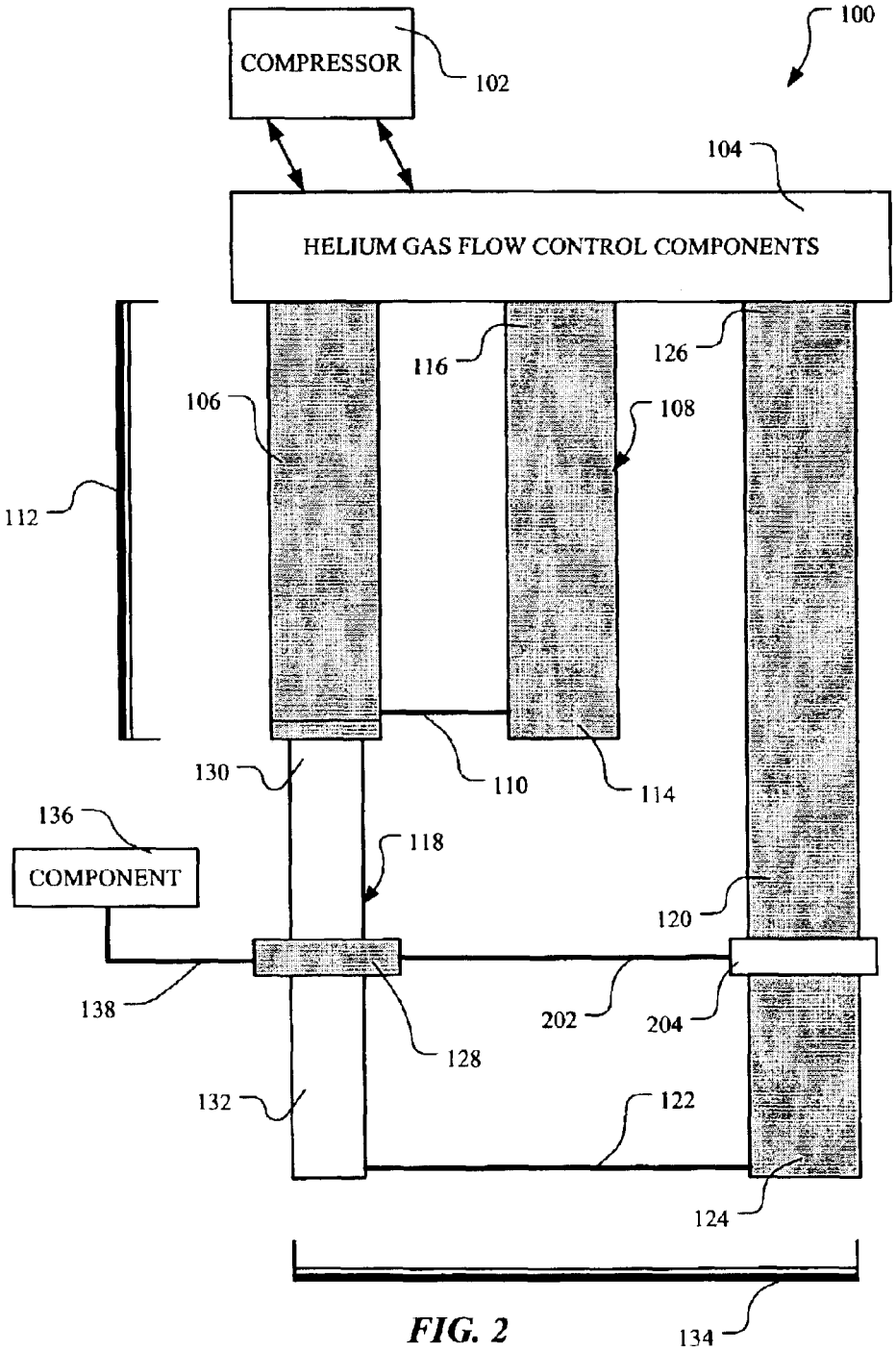
FIG. 2 is a stylized diagram of the cooling system of FIG. 1 having a heat intercept thermally linked to the heat exchanger.

One or more various components 136, such as mechanical structures, electrical cabling, leads, thermal shields, and/or other components linking the second stage 134 and the first stage 112 or linking the second stage 134 and the surrounding environment may be thermally linked to the heat exchanger 128 via a thermal link 138. Referring now to FIG. 2, the heat exchanger 128 may also be thermally coupled via a thermal link 202 to a thermal intercept 204 that is attached to, or inserted within, the second pulse tube 120. The thermal intercept 204 is generally designed for transmitting heat from the second pulse tube 120 to the thermal link 202. In one embodiment, the thermal intercept 204 is attached to the second pulse tube 120 within a physical area or zone thereof that operates within a temperature range of about 8K to about 20K. Generally, the thermal intercept 204 comprises a high thermally conductive material (e.g., copper, a copper alloy, aluminum, an aluminum alloy, or the like) wrapped around the second pulse tube 120 and/or inserted within the second pulse tube for more efficient thermal exchange. In one embodiment, the thermal intercept 204 has a configuration corresponding to that of the heat exchanger 128. In other words, the thermal intercept 204 may be disposed between two portions of the second pulse tube 120.

The thermal link 138 may comprise any desired thermally conductive structure for transmitting heat from the component 136 to the heat exchanger 128. For example, the thermal link 138 may comprise a metallic (e.g., copper, a copper alloy, aluminum, an aluminum alloy, or the like) portion extending between the component 136 and the heat exchanger 128. In other embodiments, the thermal link may comprise a metallic (e.g., copper, a copper alloy, aluminum, an aluminum alloy, or the like) braid covering at least a portion of a cable or lead and extending to the heat exchanger 128. The thermal link may, in one embodiment, comprise a heat pipe extending between the component 136 and the heat exchanger 128. Generally, a heat pipe comprises a sealed container made of a high thermal conductivity material having inner surfaces with a capillary wicking material.

The heat exchanger 128 may comprise various configurations, such as those shown in FIGS. 3A–3F. For example, a first illustrative embodiment of the heat exchanger 128, shown in FIGS. 3A (front view) and 3B (side view), may comprise a plurality of plates 302 (only one is labeled for ease of illustration) defining a plurality of openings 304 (only one is labeled for ease of illustration) therethrough. In such an embodiment, the openings 304 defined by each plate 302 are generally aligned to allow fluid flowing through the second regenerator 118 to communicate therethrough, so that heat may be transferred to the helium from the walls of the openings 304.

Figure 3A:
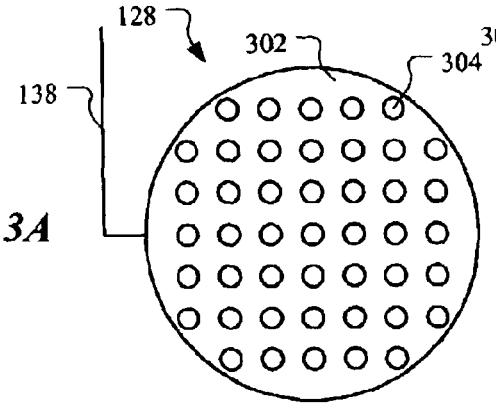
FIG. 3A is a front view of a first illustrative embodiment of a heat exchanger according to the present invention.
Figure 3B:
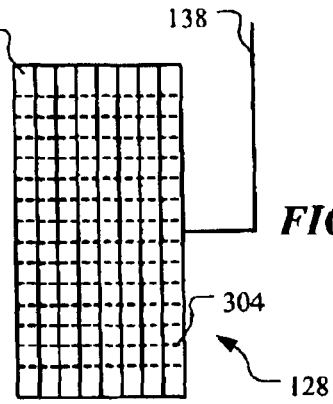
FIG. 3B is a side view of the heat exchanger of FIG. 3A.
Figure 3C:
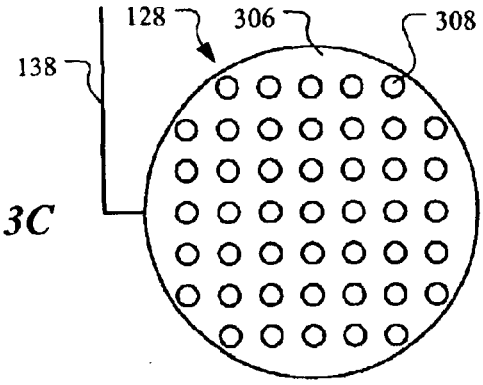
FIG. 3C is a front view of a second illustrative embodiment of a heat exchanger according to the present invention.
Figure 3D:
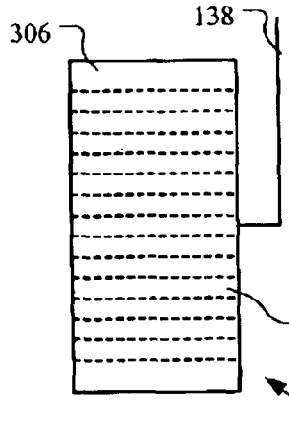
FIG. 3D is a side view of the heat exchanger of FIG. 3C.

Alternatively, a second illustrative embodiment of the heat exchanger 128, is shown in FIGS. 3C (front view) and 3D (side view). This second embodiment may comprise a block 306 defining a plurality of openings 308 (only one is labeled for ease of illustration) therethrough, such that fluid flowing through the second regenerator 118 may communicate through the openings 308. The second embodiment may, in certain situations, have greater thermal exchange capabilities and than the first embodiment, since the second embodiment omits interfaces between the plates 302. In each of the first and second embodiments, the heat exchanger 128 comprises a high thermal conductivity material, such as copper, a copper alloy, aluminum, or an aluminum alloy.

Figure 3E:
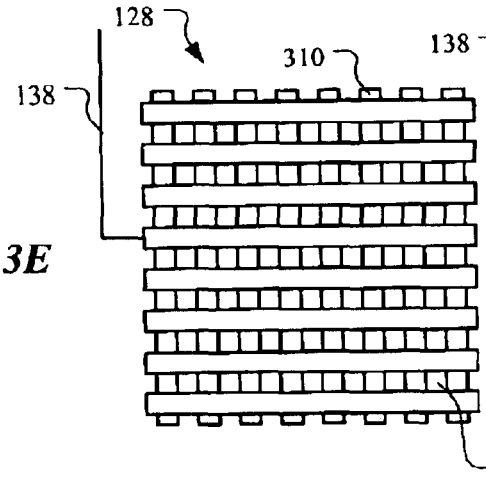
FIG. 3E is a front view of a third illustrative embodiment of a heat exchanger according to the present invention.
Figure 3F:
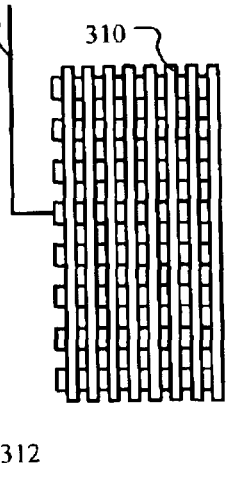
FIG. 3F is a side view of the heat exchanger of FIG. 3E.

FIGS. 3E (front view) and 3F (side view) depict a third illustrative embodiment of the heat exchanger 128, which comprises a grid 310 of thermally conductive material (e.g., copper, a copper alloy, aluminum, an aluminum alloy, or the like). The grid 310 defines openings 312 (only one indicated) that allow fluid flowing through the second regenerator 118 to communicate therethrough. The third embodiment may, in certain situations, have greater thermal exchange capabilities over the first and second embodiments due to a greater amount of surface area over which helium may flow.

The thermal intercept 204, in various embodiments, may have configurations corresponding to the embodiments of the heat exchanger 128 depicted in FIGS. 3A–3F. In other words, the thermal intercept 204 may be disposed within the pulse tube 120 and comprise a plurality of plates defining a plurality of openings therethrough, a block defining a plurality of openings therethrough, or a grid defining a plurality of openings therethrough. In each case, openings allow helium to flow therethrough and a thermal exchange occurs between the helium and the walls of the openings.

While the heat exchanger 128, the thermal links 138, 202, and the thermal intercept 204 are shown in FIGS. 1–3F as being used with a pulse tube type cooling system, the present invention is not so limited. Rather the heat exchanger 128, the thermal links 138, 202, and the thermal intercept 204 may be used with any cooling system having a regenerator-type device, such as Stirling cooling systems and Gifford-McMahon cooling systems.

Figure 4A:
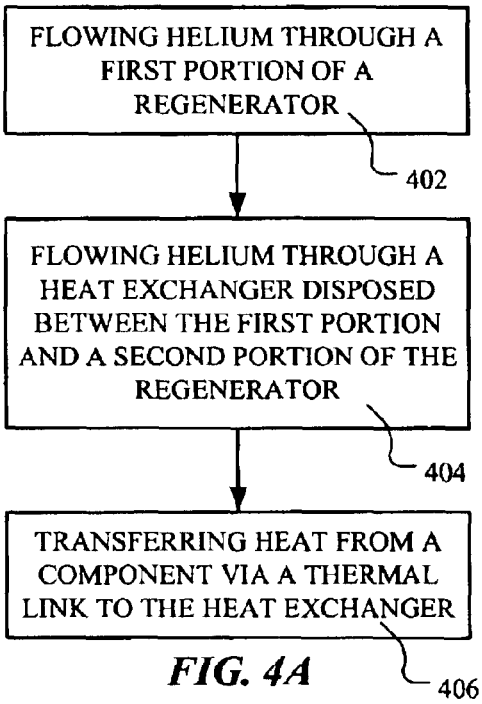
FIGS. 4A–4D are block diagrams representing various illustrative embodiments of a method of extracting cooling power from helium in a regenerator according to the present invention.

FIG. 4A depicts a first illustrative embodiment of a method of extracting cooling power from helium in the regenerator 118 according to the present invention. The method includes flowing helium through the first portion 130 of the regenerator 118 (block 402) and flowing the helium through the heat exchanger 128 disposed between the first portion 130 and the second portion 132 of the regenerator 118 (block 404). The method further includes transferring heat from the component 136 via the thermal link 138 to the heat exchanger 128 (block 406).

Figure 4B:
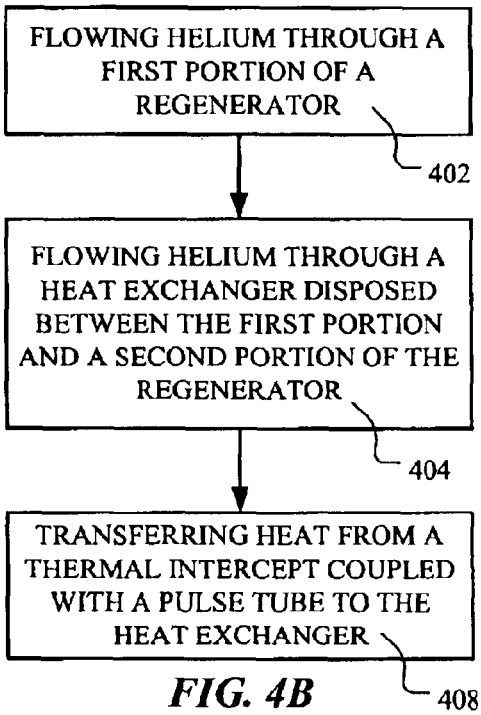

FIG. 4B depicts a second illustrative embodiment of a method of extracting cooling power from helium in the regenerator 118 according to the present invention. The method includes blocks 402, 404 as described above concerning FIG. 4A. The method further includes transferring heat from the thermal intercept 204 coupled with the pulse tube 120 to the heat exchanger 128 via the thermal link 202 (block 408). In this way, heat may be extracted from the pulse tube 120 to enhance its cooling capabilities.

Figure 4C:
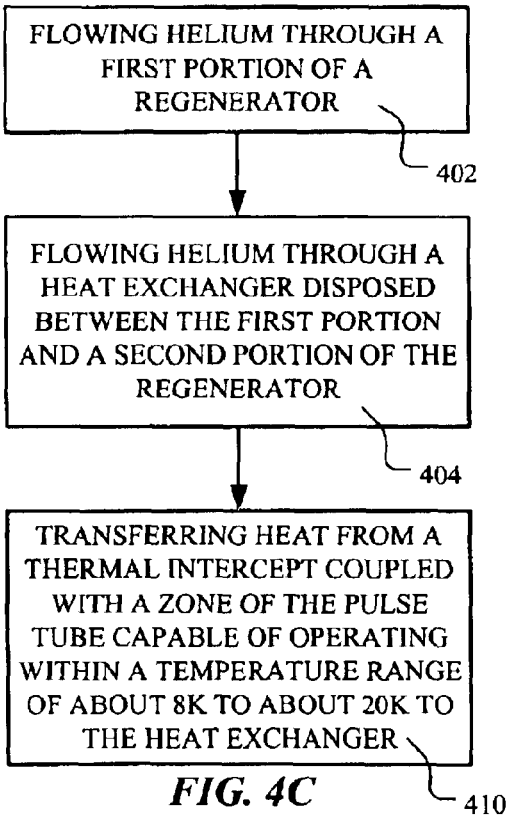

FIG. 4C depicts a third illustrative embodiment of a method of extracting cooling power from helium in the regenerator 118 according to the present invention. The method includes blocks 402, 404 as described above concerning FIG. 4A. The method further comprises transferring heat from the thermal intercept 204 coupled with a zone of the pulse tube 120 capable of operating within a temperature range of about 8K to about 20K to the heat exchanger 128 via the thermal link 202 (block 410). In this way, the cooling capability of the pulse tube 120 may be enhanced by taking advantage of the greatest enthalpy difference of helium within the pulse tube 120, which is within a temperature range of about 8K to about 20K.

Figure 4D:
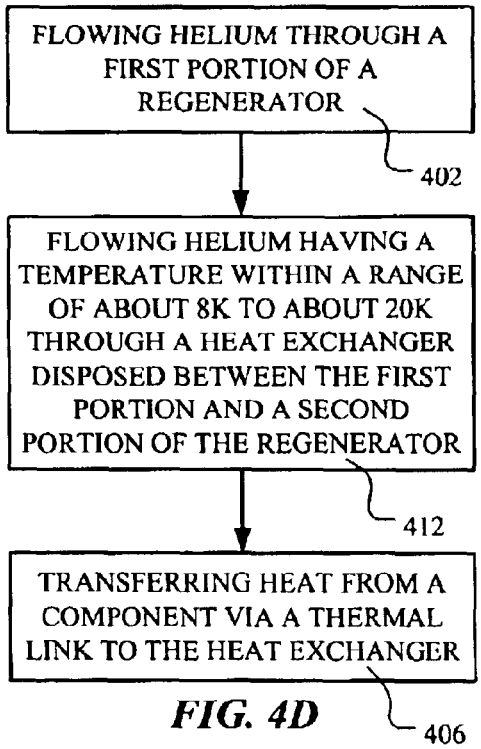

FIG. 4D depicts a fourth illustrative embodiment of a method of extracting cooling power from helium in the regenerator 118 according to the present invention. The method includes blocks 402, 406 as described above concerning FIG. 4A. The method further includes flowing helium having a temperature within a range of about 8K to about 20K through the heat exchanger 128, which is disposed between the first portion 130 and the second portion 132 of the regenerator 118. In this way, the cooling capability of the helium within the regenerator 118 may be enhanced by taking advantage of the greatest enthalpy difference of helium therein, which is within a temperature range of about 8K to about 20K.

While the embodiments concerning FIGS. 4A–4D have been described in relation to particular elements shown in FIGS. 1–3, the present invention is not so limited. Rather, the scope of the present invention encompasses the use of the various method embodiments disclosed herein with any chosen elements of a cooling system.

Implementing the multi-stage cooling system illustrated by embodiments of the present invention to extract cooling power from helium provides for improved thermal efficiencies over the prior art systems by using previously unutilized cooling power of helium flowing through the regenerator 118 to cool one or more related components, thus decreasing the parasitic thermal load on the cooling system.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus for extracting cooling power from helium flowing through a cooling system regenerator, comprising:

a cooling system comprising a regenerator, a component that is external to the cooling system, a heat exchanger disposed within the regenerator capable of extracting cooling power from the helium, wherein the heat exchanger is disposed within a zone of the regenerator capable of operating within a temperature range of about 8K to about 20K: and a thermal link coupled to the heat exchanger for thermally coupling the heat exchanger with the component.

2. An apparatus, according to claim 1, wherein the heat exchanger comprises a material selected from the group consisting of copper, a copper alloy, aluminum, and an aluminum alloy.

3. An apparatus, according to claim 1, wherein the heat exchanger comprises a plurality of stacked plates, each plate defining a plurality of openings therethrough for communication of the helium so that cooling power may be extracted from the helium.

4. An apparatus, according to claim 1, wherein the heat exchanger comprises a block defining a plurality of openings therethrough for communication of the helium so that cooling power may be extracted from the helium.

5. An apparatus, according to claim 1, wherein the heat exchanger comprises a grid defining a plurality of openings therethrough for communication of the helium so that cooling power may be extracted from the helium.

6. An apparatus, according to claim 1, wherein the thermal link comprises a material selected from the group consisting of copper, a copper alloy, aluminum, and an aluminum alloy.

7. An apparatus, according to claim 1, wherein the thermal link comprises a metallic portion.

8. An apparatus, according to claim 1, wherein the thermal link comprises a metallic braid.

9. An apparatus, according to claim 1, wherein the thermal link comprises a heat pipe.

10. An apparatus, according to claim 1, wherein the thermal link is capable of being coupled with a heat intercept thermally coupled with a pulse tube.

11. An apparatus, according to claim 1, wherein the thermal link is capable of being coupled with at least one of a mechanical structure, an electrical lead, a cable, and a thermal shield.

12. An apparatus, according to claim 1, wherein the heat exchanger is capable of being disposed within a pulse tube cooling system regenerator.

13. An apparatus, according to claim 1, wherein the heat exchanger is capable of being disposed within a Stirling cooling system regenerator.

14. An apparatus, according to claim 1, wherein the heat exchanger is capable of being disposed within a Gifford-McMahon cooling system regenerator.

15. An apparatus for extracting cooling power from helium flowing through a cooling system regenerator, comprising a cooling system comprising a regenerator, a component that is external to the cooling system, and means for transferring heat from the component to the helium flowing through the regenerator, wherein the means for transferring the heat is disposed within a zone of the regenerator capable of operating within a temperature range of about 8K to about 20K.

16. An apparatus, according to claim 15, wherein the means for transferring the heat further comprises a heat exchanger disposed within the regenerator.

17. An apparatus, according to claim 16, wherein the means for transferring the heat further comprises a thermal link coupled with the regenerator and the component.

18. A cooling circuit, comprising:

a cooling system comprising a regenerator, a component that is external to the cooling system, the regenerator capable of allowing helium to flow therethrough;

a heat exchanger disposed within the regenerator and being capable of extracting cooling power from the helium, wherein the heat exchanger is disposed within a zone of the regulator capable of operating within a temperature range of about 8K to about 20K; and a thermal link coupled to the heat exchanger for thermally coupling the heat exchanger with the component.

19. A cooling circuit, according to claim 18, wherein the heat exchanger comprises a material selected from the group consisting of copper, a copper alloy, aluminum, and an aluminum alloy.

20. A cooling circuit, according to claim 18, wherein the heat exchanger comprises a plurality of stacked plates, each plate defining a plurality of openings therethrough for communication of the helium so that cooling power may be extracted from the helium.

21. A cooling circuit, according to claim 18, wherein the heat exchanger comprises a block defining a plurality of openings therethrough for communication of the helium so that cooling power may be extracted from the helium.

22. A cooling circuit, according to claim 18, wherein the heat exchanger comprises a grid defining a plurality of openings therethrough for communication of the helium so that cooling power may be extracted from the helium.

23. A cooling circuit, according to claim 18, wherein the thermal link comprises a material selected from the group consisting of copper, a copper alloy, aluminum, and an aluminum alloy.

24. A cooling circuit, according to claim 18, wherein the thermal link comprises a metallic portion.

25. A cooling circuit, according to claim 18, wherein the thermal link comprises a metallic braid.

26. A cooling circuit, according to claim 18, wherein the thermal link comprises a heat pipe.

27. A cooling circuit, according to claim 18, wherein the thermal link is coupled with at least one of a mechanical structure, an electrical lead, a cable, and a thermal shield.

28. A cooling circuit, according to claim 18, wherein the cooling system comprises a pulse tube cooling system.

29. A cooling circuit, according to claim 18, wherein the cooling system comprises a Stirling cooling system.

30. A cooling system circuit, according to claim 18, wherein the cooling system comprises a Gifford-McMahon cooling system.

31. A method of extracting cooling power from helium in a regenerator, comprising:

flowing the helium through a first portion of the regenerator;

flowing the helium through a heat exchanger disposed between the first portion and a second portion of the regenerator to transfer heat from the heat exchanger to the helium; and transferring heat from a thermal intercept via a thermal link to the heat exchanger, wherein transferring heat from the thermal intercept further comprises transferring heat from the thermal intercept coupled with a zone of a pulse tube that is capable of operating within a temperature range of about 8K to about 20K.

32. A method, according to claim 31, wherein transferring heat from the component further comprises transferring heat from the thermal intercept coupled with the pulse tube to the heat exchanger.

33. A method, according to claim 31, wherein flowing the helium through the heat exchanger further comprises flowing helium having a temperature within a range of about 8K to about 20K through the heat exchanger.

* * * * *